United States Patent [19]

Taylor et al.

[11] Patent Number: 5,059,303

[45] Date of Patent: Oct. 22, 1991

[54] OIL STABILIZATION

[75] Inventors: James L. Taylor, Naperville, Ill.; Albert L. Hensley, Munster, Ind.; John M. Forgac, Elmhurst; David F. Tatterson, Downers Grove, both of Ill.

[73] Assignee: Amoco Corporation, Chicago, Ill.

[21] Appl. No.: 367,144

[22] Filed: Jun. 16, 1989

[51] Int. Cl.[5] ..... C10G 43/08

[52] U.S. Cl. ..... 208/96; 208/143; 208/254 A; 208/301; 208/302

[58] Field of Search ..... 208/254 H, 301, 302, 208/96, 143, 97

[56] References Cited

U.S. PATENT DOCUMENTS

| | | | |
|---|---|---|---|
| 3,201,345 | 8/1965 | Hamilton | 208/143 |
| 3,256,175 | 6/1966 | Kozlowski et al. | 208/254 H |
| 3,617,476 | 11/1971 | Woodle | 208/143 |
| 3,899,412 | 8/1975 | Rowe et al. | 208/254 H |
| 4,261,813 | 4/1981 | Smith | 208/254 H |
| 4,268,378 | 5/1981 | Compton | 208/254 H |
| 4,297,206 | 10/1981 | Scheibel | 208/143 |
| 4,342,641 | 8/1982 | Reif et al. | 208/143 |
| 4,483,763 | 11/1984 | Kuk et al. | 208/254 H |
| 4,627,908 | 12/1986 | Miller | 208/143 |
| 4,695,369 | 9/1987 | Garg et al. | 208/254 H |

FOREIGN PATENT DOCUMENTS

| | | | |
|---|---|---|---|
| 206486 | 11/1984 | Japan | 208/254 H |

*Primary Examiner*—Helane E. Myers

*Attorney, Agent, or Firm*—Nick C. Kottis; William H. Magidson; Ralph C. Medhurst

[57] ABSTRACT

A method for stabilizing oil is provided. An oil fraction having hydrocarbons with an initial boiling point of about 200° F. to about 1050° F. is hydrotreated to reduce the nitrogen content of the oil fraction to be stabilized. Subsequently, condensed aromatic compounds are selectively extracted from the hydrotreated oil fraction to yield a stable oil fraction.

41 Claims, 1 Drawing Sheet

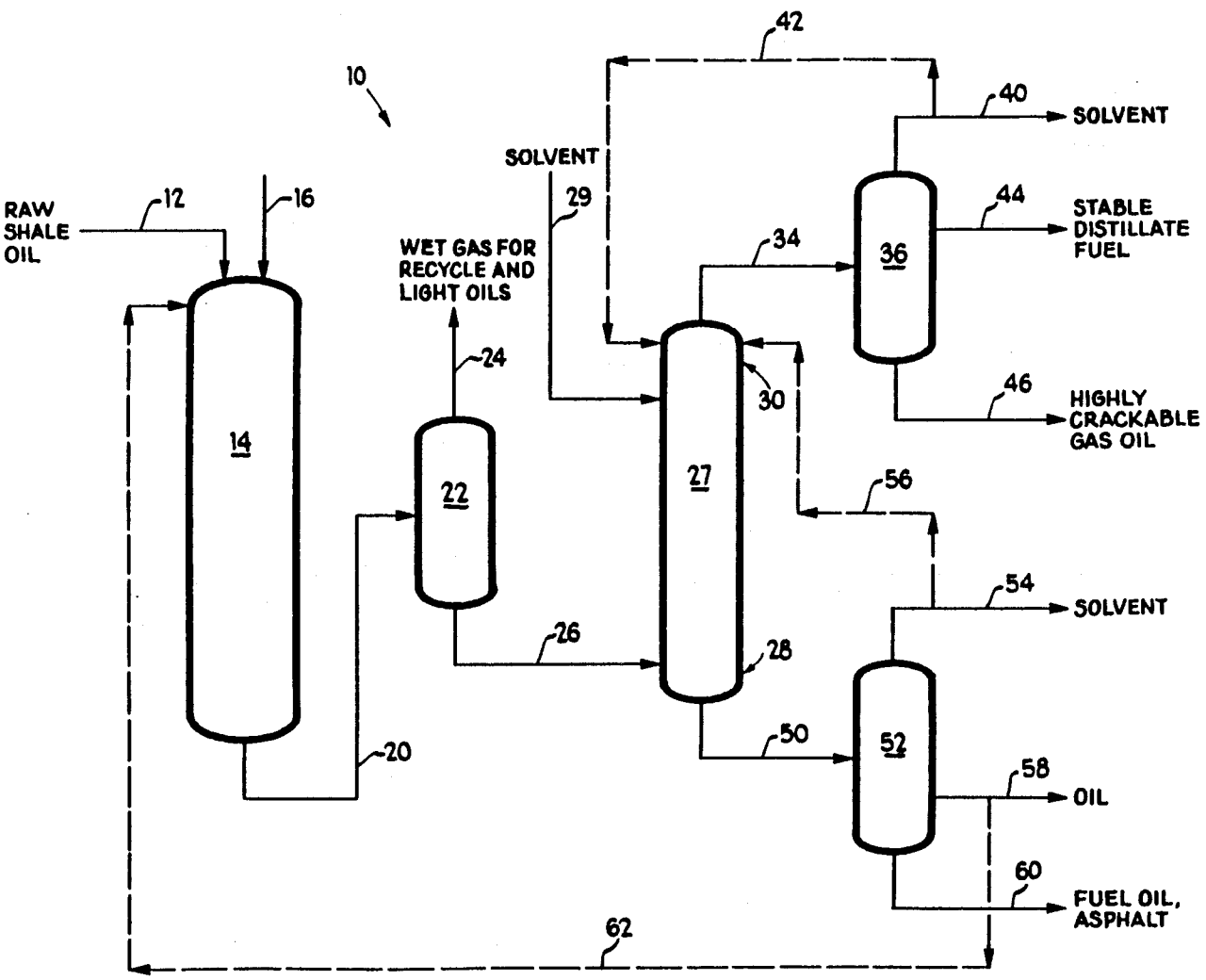
SOLVENT
STABLE DISTILLATE FUEL
HIGHLY CRACKABLE GAS OIL
SOLVENT
OIL
FUEL OIL, ASPHALT
40
44
46
54
58
60
36
52
56
42
34
30
28
50
27
62
SOLVENT
29
26
WET GAS FOR RECYCLE AND LIGHT OILS
24
22
20
10
16
14
12
RAW SHALE OIL

OIL STABILIZATION

BACKGROUND OF THE INVENTION

This invention relates generally to the field of oil upgrading and, more particularly, to the stabilization of oil or fractions thereof from at least some of the harmful effects of exposure to light, heat and oxygen, for example.

As petroleum reserves dwindle, crude shale oil and other syncrudes have and will become increasingly important as refinery feedstocks. While in many respects crude shale oil, such as that which results upon the retorting of oil shale, is similar to heavier petroleums, e.g., both have similar hydrogen-to-carbon ratios, they differ in several important aspects. For example, crude shale oils derived from the Green River oil shale deposits of Colorado, Utah, and Wyoming generally have lower sulfur and higher oxygen contents than heavier petroleums. In addition, while crude shale oils typically may contain metals, especially arsenic, which may present some relatively unique refining problems, it is the comparatively high nitrogen loading of crude shale oils that is the principal distinguishing characteristic which makes such shale oils generally unsuitable for use as a conventional refinery feed. For example, typical petroleums generally contain around 0.2 weight percent of nitrogen whereas crude shale oils generally contain in the range of about 1 to about 3 weight percent or more of nitrogen. Also, the nitrogen compounds present in petroleums are generally concentrated in the higher boiling ranges whereas the nitrogen compounds present in crude shale oils are generally distributed throughout the boiling range of the material. Further, the nitrogen compounds in petroleum are predominantly nonbasic compounds, whereas generally about half the nitrogen compounds present in crude shale oils are of a basic nature. Such basic nitrogen compounds are particularly undesirable in refinery feedstocks as such compounds frequently act as severe catalyst poisons. Consequently, crude shale oils, such as those produced upon the retorting of oil shale, generally must be upgraded prior to use as a feedstock that can be commingled with conventional petroleum streams for refining to transportation fuels.

In the view of the problems associated with the presence of nitrogen in oil, particularly syncrude oils, and more particularly crude shale oils, various techniques and procedures for the removal of nitrogen therefrom have been developed. One commonly used technique for nitrogen removal from shale oils is through catalytic hydrotreatment. In such hydrotreatment, crude shale oil and hydrogen are reacted over a catalyst bed at an elevated temperature and pressure to effect olefin and aromatic bond saturation, removal of metals, sulfur, nitrogen and oxygen from the oil, and cleavage of carbon-carbon bonds. These reactions result in the "consumption" of molecular hydrogen by the oil as the hydrogen content of the oil is increased. Typical hydrotreating catalysts used include Ni-Mo, Co-Mo or Ni-W on high surface area, dispersed aluminas. In addition, the catalyst may, for example, be promoted, such as by the addition of P to a Ni-Mo catalyst. Typical catalytic hydrotreating reaction conditions include hydrogen pressures of about 500–3000 psi, operating temperatures of about 600–800° F., and space velocities of about 2 to 0.1 LHSV (liquid volume of oil fed per volume of catalyst per hour). In addition to nitrogen removal, hydrotreatment results in other beneficial or desirable effects such as an increased hydrogen-to-carbon ratio, sulfur and oxygen removal, olefin and aromatic bond removal or saturation and conversion of vacuum residuum hydrocarbons, i.e., hydrocarbons boiling in the 1000+° F. range, to lower boiling range components.

However, hydrotreatment (with the accompanying removal of nitrogen) does not, in and of itself, assure the Stability of the material being treated, e.g., shale oil or particular fractions thereof, such as the "distillate" fraction (i.e., the fraction of the shale oil typically having an initial boiling point in the general range of about 350° F. to about 650° F.), where stability refers to the ability of material to resist discoloration and sediment formation upon exposure to heat, light or oxygen. For example, the presence of both nitrogen and aromatics in a shale oil being processed are believed to contribute to the relative instability of samples of such shale oil as the nitrogen may act to sensitize the aromatics to ultraviolet and/or oxidative induced instability. Furthermore, the severe hydrotreating generally required to obtain shale oil nitrogen levels corresponding to those of typical petroleums frequently results in undesirable processing consequences, such as requiring or resulting in:

1) severe operating conditions, such as high temperatures, hydrogen pressures, or reactor residence times, which conditions and equipment associated therewith are typically relatively costly to obtain, operate and manage;

2) increased production of $C_1$ to $C_4$ hydrocarbons from the feedstock;

(3) high hydrogen consumption, in view of the high reaction rates associated with severe hydrotreatment, as hydrogen consumption is believed to increase exponentially with the extent of nitrogen removal; and 4) incapability of using back-mixed, ebullated beds, as it is generally difficult to achieve the high extent of nitrogen removal required by processing dependent on severe hydrotreating through the use of such beds. This despite the fact that ebullated bed type reactors are generally well suited for the treatment of materials, such as inorganic solid contaminated materials, such as shale oils, as ebullated bed reactors are generally well suited to or for: a) removal of organic metals and other fouling reactants; b) handling of the high amounts of heat that accompany hydrotreatment; and c) conversion of 1000° F.+shale oil material (as compared to fixed bed reactors). It is noted, however, that inorganic fine solids, when present in ebullated beds, can cause processing problems such as increased process equipment erosion through abrasion and increased fouling of the catalyst in the reactor.

An alternative technique for the removal of nitrogen from oils, particularly syncrude oils such as crude shale oils, that has been utilized with varying degrees of success is commonly referred to as liquid-liquid (solvent) extraction or selective adsorption. Typically, in such solvent extraction techniques, an incoming liquid mixture such as a synfuel liquid which also contains nonhydrocarbons such as nitrogen compounds, e.g., pyridines, and oxygenated compounds, e.g., phenols, is extracted by a solvent selective for the nonhydrocarbons contained in the synfuel liquid. The removal of nitrogen compounds from a syncrude stream such as raw shale oil, for example, by such extraction alone, however, is generally unlikely to be practical. For example, generally about 50 percent of the oils from aboveground retorts contain nitrogen. Consequently, because such liquid-liquid extraction results in a diminishment in the amount of shale oil recovered thereby, sole reliance on liquid-liquid extraction of nitrogen compounds therefrom will in most cases result in yield losses so severe as to be impractical, e.g., yield losses typically of 50 percent or more. Further, as the amount of solvent required for such extraction will generally be proportional to the quantity of the material to be extracted, typically relatively large quantities of solvent will be required, which in turn will correspondingly increase the cost of solvent recovery and recycle for the process. In addition, effective selective extraction may be difficult to achieve as the nitrogen compounds are of a ubiquitous nature and while raw shale oil generally contains a substantial quantity of nonbasic nitrogen compounds (typically about 1 weight percent or more of the oil), acidic solvents generally tend to be selective for basic nitrogen compounds and are typically relatively ineffective for the extraction of such nonbasic compounds.

U.S. Pat. No. 4,297,206 discloses a method of solvent extraction of synfuel liquids involving an integration of hydrotreatment and extraction. The process disclosed therein involves hydrotreating, rather than recycling directly back to the extractor, the extract resulting upon extraction.

Such a method appears to suffer from at least some of the disadvantages identified above with respect to liquid-liquid (solvent) extraction. For example, large quantities of solvent would appear to be needed for the initial extraction processing. While the use of large quantities of solvent increases the desirability of incorporating some form of solvent recycle and recovery in the process, it would also increase the costs associated therewith. Also, such a technique does not appear to overcome the ubiquitous nature of the nitrogen compounds in the shale oil. Moreover, in such processing only a portion of the shale oil being processed receives the beneficial effects of the hydrotreatment, which follows the extraction processing.

SUMMARY OF THE INVENTION

It is an object of the present invention to overcome one or more of the problems described above.

According to the invention, an oil fraction comprising hydrocarbons having an initial boiling point of from about 200° F. to about 1050° F. is stabilized from an oil feedstock including such an oil fraction by a process involving hydrotreating the oil feedstock followed by removing condensed aromatic compounds from at least the oil fraction to be stabilized of the hydrotreated feedstock. In hydrotreating the oil feedstock, the nitrogen content of the oil fraction to be stabilized is reduced to a range of about 200 ppm to about 10,000 ppm. The process then continues with solvent extraction, which selectively removes condensed aromatic compounds as well as at least some of any remaining undesirable (relative to distillate stability) nitrogen compounds from the hydrotreated stream.

As used herein, the terms "stable" and "stability" refer to the ability of the material fuel to resist discoloration and sediment formation upon exposure to heat, light or oxygen. (The stability of middle distillates is commonly measured by ASTM test D2274, while the stability of jet fuels is commonly measured by ASTM test D3241.)

The invention has particular perceived utility in the treatment of relatively high nitrogen content hydrocarbon feedstocks.

As used herein, the term "hydrogenation" refers to any reaction of hydrogen with an organic compound. It may occur either as direct addition of hydrogen to the double bonds of unsaturated molecules, resulting in a saturated product, or it may cause rupture of the bonds of organic compounds, with subsequent reaction of hydrogen with the molecular fragments. An example of the first type is the processing commonly referred to as "hydrotreatment." An example of the second type is the processing commonly referred to as "hydrocracking."

Also, all references herein to initial boiling points (IBPs), unless otherwise indicated, refer to the initial boiling point of the specified material under atmospheric conditions.

Other objectives and advantages of the invention will be apparent to those skilled in the art from the following detailed description, taken in conjunction with the appended claims and drawing.

BRIEF DESCRIPTION OF THE DRAWING

The figure is a simplified, schematic flow diagram of a system for stabilizing raw shale oil according to a typical embodiment of the present invention.

DETAILED DESCRIPTION OF THE INVENTION

The invention contemplates a system effective in stabilizing an oil fraction comprising hydrocarbons boiling in the temperature range of 200° F. to about 1050° F.

Referring to the figure, an oil stabilization system, generally designated 10, to treat and stabilize oils, including naturally occurring oils and syncrude liquids such as those oils derived from solid, hydrocarbon-containing materials, e.g., oil shale, tar sands, uinaite (gilsonite) and oil-containing diatomaceous earth (diatomite) or fractions of such oils, is shown. While the present invention is described hereinafter with particular reference to the stabilization of shale oil (derived from the processing of oil shale), it will be apparent that the process and system can also be used in connection with the stabilization of other oil feedstocks; including the oils derived from the processing of other solid, hydrocarbon-containing materials such as tar sands, unitate (gilsonite), oil-containing diatomaceous earth, etc., or those naturally occurring petroleum oils conducive to stabilization therewith. As the atomic ratio of hydrogen to carbon in the feedstock oil reflects the percentage or degree of aromaticity of the oil, with lower hydrogen to carbon atomic ratios indicating a greater relative amount of aromatics, the invention is preferably utilized in the treatment of such of these feedstock oils having a hydrogen-to-carbon atomic ratio of about 1.4 or more with the invention having particular utility in the treatment of those feedstock oils having a hydrogen-to-carbon atomic ratio of about 1.6. Thus, the invention may be unsuitable for use in the treatment of highly aromatic feed streams, e.g., certain coal liquids.

In the system 10, a stream 12 of raw/crude shale oil is fed into a hydrotreater 14. Such raw/crude shale oil, as described above, typically contains in the range of about 1 to 3 weight percent or more of nitrogen. Also fed to the hydrotreater 14 is a stream 16 which includes hydrogen in an amount sufficient to effect the selected extent of hydrotreatment of the raw shale oil fed to the hydrotreater 14. The stream 16 may, if desired, also include recycle gas which typically includes hydrogen and light hydrocarbons ($C_1$–$C_4$), with water, ammonia and hydrogen sulfide removed prior to feeding such recycle gas to the hydrotreater 14. When such hydrogen gas recycle is utilized, i.e., when the hydrogen feed to the hydrotreater is at least partially derived from such recycle gas, the volumetric ratio of recycle gas to hydrogen make-up gas will typically range from about 1:1 to about 10:1 (volume of recycle gas to volume of hydrogen make-up gas), with a ratio of about 3 volumes of recycle gas to 1 volume of hydrogen gas being a typically preferred ratio.

In the hydrotreater 14, the nitrogen content of the raw shale oil fraction boiling in the temperature range of about 200° F. to about 1050° F. is reduced to a range of about 200 ppm to about 10,000 ppm. In this fashion a bulk of the heteroatoms contained in the raw/crude shale oil are removed prior to further treatment of the shale oil.

It is to be understood that, if desired, the raw/crude shale oil may be pretreated such as by dedusting as described in U.S. Pat. No. 4,544,477 or ramscarbon removal (as crude shale oils typically contain less than about 5 weight percent ramscarbon or RAMS, as such material is commonly referred to) in a delayed or fluid-bed coker prior to being subjected to hydrotreatment in accordance with the invention.

A stream 20 of hydrotreated shale oil exits the hydrotreater 14. Such hydrotreated shale oil typically includes a "naphtha" fraction (i.e., the fraction of the shale oil having an initial boiling point (IBP) of about 50° F. to about 350° F.), a "middle distillate" or "jet and distillate fuel" fraction (i.e., the fraction of the shale oil having an IBP of about 350° F. to about 650° F.) and a "gas oil" fraction (i.e., the fraction of the shale oil having an IBP of about 650° F. to about 1000° F. to about 1050° F.) with "lube oils" (having an IBP of about 650° F. to about 850° F.) being a subclass of gas oils. Further, hydrotreated shale oil typically includes these fractions, i.e.,(naphtha):(jet and distillate fuels):(gas oil), in a relative ratio of about 1:3:3 for thermally retorted oils and in a relative ratio of about 1:1:0 for shale oils retorted using a cracking catalyst, respectively.

Additionally, hydrotreated shale oil may contain a "vacuum residuum" oil fraction (also referred to as a "resid" oil fraction, i.e., the fraction of the material having an IBP of more than about 1000° F., e.g., more than about 1050° F.). In hydrotreated shale oil, however, such "vacuum residuum oils" are typically present in only relatively minor proportions. It is to be understood, however, that such vacuum residuum oils may be present in relatively greater proportions when the process of the invention is applied to the treatment of other oil feedstocks, such as petroleums, oil sands and tar sands bitumen, for example.

The stream 20 of hydrotreated shale oil is then fed to a fractionator 22. The fractionator 22 serves to separate the hydrotreated shale oil into a light oils fraction of hydrotreated material, shown as stream 24, and a heavier oil fraction of hydrotreated material, shown as a stream 26. The light oils fraction largely contains hydrogen, $C_1$–$C_7$ hydrocarbons, ammonia, hydrogen sulfide and water. Following the removal of ammonia, hydrogen sulfide, water and condensible hydrocarbons (e.g., $C_4$+ hydrocarbons), the remaining light gas in stream 24 can, if desired, be recycled to the hydrotreater 14 to conserve hydrogen through the utilization of the hydrogen contained therein for the hydrotreatment of feed being so treated. An oil fraction stream 26 is fed to an extractor 27 wherein solvent extraction of the oil fraction is effected. It is to be understood that the hydrotreated shale oil exiting the hydrotreater 14 can be fractionated and, if desired, only selected of the lighter or heavier oil streams subsequently being subjected to extraction. Generally, some sort of intervening fractionation, e.g., fractionation of the hydrotreated stream prior to the treatment of at least some of the material thereof by extraction or other means of condensed aromatic compound removal, to remove by-products of hydrotreatment (such as water, ammonia, and hydrogen sulfide), hydrogen, light hydrocarbon gases, lighter oils with low heteroatom contents (e.g., which typically contain only about 10 ppm to about 100 ppm of nitrogen) or heavier oil fractions having higher heteroatom contents where such higher heteroatom contents are tolerable in downstream refining processes, such as in catalytic cracking and delayed coking, will be desired. Also, if desired, selected of these fractions may be recycled to the hydrotreater for further hydrotreatment. It is to be understood, however, that the invention can be practiced without such intervening fractionation, if desired.

The oil fraction stream 26 is fed into a lower portion 28 of the extractor or extraction column 27 while a stream 29 of a suitable solvent is fed into a top portion 30 of the extractor 27 to effect countercurrent extraction of the oil fraction. To obtain efficient countercurrent extraction, a density differential, i.e., a difference in the density of the oil and that of the solvent, of at least about 0.05 gram/cubic centimeter will be preferred.

It is to be understood that while the invention is described herein with reference to the use of a countercurrent column to effect the extraction of the oil fraction, the invention also comprehends the use of other extraction means such as mixer-settler stages, for example. It is also to be understood that, if desired, in place of or as a supplement to aromatic compound removal by extraction, other means of aromatic compound removal conditioning, such as by membrane separation, may be utilized in the practice of the invention. It is further to be understood that, if desired, multiple aromatic compound removal conditioning means, such as two or more extraction columns or an extraction column and a membrane separator, for example, may be used with different aromatic compound removal conditioning means, e.g., different extraction columns, being used in the treatment of various selected oil fractions resulting from the fractionator. Alternatively, the same aromatic compound removal conditioning means, e.g., extractor, can be used in some sequential fashion to treat various of these selected oil fractions with, if desired, various of the operating parameters, such as for a solvent extractor the solvent and/or operating conditions such as temperature, being tailored to the fraction presently being treated therein.

Suitable solvents include those solvents broadly characterized as aromatic extraction solvents such as N-methyl pyrrolidone, furfural, dimethyl formamide or phenol; or aqueous solutions of such aromatic extraction solvents, generally containing no more than about 20 volume percent water, preferably containing no more than about 10–15 volume percent water and, generally, more preferably no more than about 10 volume percent water, particularly such aqueous solutions of N-methyl pyrrolidone and dimethyl formamide, as the selectivity of removal of condensed aromatics and nitrogen compounds is improved by adding water to these solvents during such extraction. It is to be understood that the amount of water utilized in such aqueous solutions will be at least in part dependent on such factors as the operating temperature and the solvent-to-feed ratio, for example. Further, the addition of water to these solvents will typically result in the extraction of relatively fewer compounds from the material being treated but with increased extraction selectivity for offending compounds, e.g., those compounds that promote or cause instability in the material being treated, condensed aromatic compounds, for example. Further, such solvents are to be distinguished from the above-referred to acidic solvents or solvent mixtures which contain acids, as such acidic solvents and solvent mixtures which contain acids are generally relatively ineffective in oil stabilization for the extraction of nonbasic compounds from shale oil.

The selection of a specific solvent for use in the practice of the invention will be, at least in part, determined by the operational objective that the solvent be relatively easily recoverable, e.g., that the solvent and nonaromatic fraction of the oil being treated are poorly miscible with each other. Such phase separation of the solvent and nonaromatic oil fraction is favored by operation at lower temperatures (e.g., preferably operation is at temperatures ranging between ambient temperature and about 200° F.), addition of water to the solvent, and utilization of the solvent in a solvent-to-feed ratio near or above one. Thereby the method of the present invention provides the user thereof with increased processing flexibility.

In addition, as the material being treated is subjected to hydrotreatment (with associated substantial reductions in the amounts or removal of aromatic and nitrogen-containing compounds therefrom) prior to extraction, reduced solvent-to-feed ratios can be utilized in the extraction step as compared to processes relying solely or principally on extraction treatment for the stabilization of the treated material.

Further, the operating conditions of the extractor will be preferably selected to favor selective extraction of aromatics. For example, extraction of aromatics typically occurs at lower temperatures (e.g., aromatics extraction is typically conducted at a temperature in the general range of ambient temperature to about 300° F., with extraction temperatures below about 200° F. typically being preferred). Further, selective extraction of aromatics can be favored by selectively extracting a relatively narrow boiling range material. Thus, selective extraction of aromatics is favored by treating a material having a boiling range of about 350° F. to about 650° F. as opposed to treating a material having a boiling range of about 350° F. to about 1000° F.-1050° F., for example.

In the extractor 27 the oil fraction contacts the solvent. The extractor 27 is designed to provide the proper degree of contact, suitable residence time for phase disengagement between mixing zones and sufficient mixing zones or stages to provide the desired degree of separation of the components in the oil fraction. In the extractor 27, condensed aromatic hydrocarbons, including those condensed aromatic hydrocarbons containing nitrogen, are selectively removed from the oil by the solvent.

The extractor 27 produces two product phases, a raffinate phase and an extract phase. The raffinate phase (containing predominantly nonaromatic hydrocarbons, with some aromatic hydrocarbons, and a small amount of solvent) leaves the extractor 27 via a stream 34. The stream 34 in turn is fed to a raffinate fractionator 36 wherein the raffinate product stream is stripped of solvent, shown as a stream 40, which may, if desired, be recycled in whole or in part to the extractor 27, as shown in phantom by stream 42.

The raffinate fractionator 36 also serves to separate a stable distillate fuel material from the raffinate, shown as a flow stream 44. In this fashion, middle distillates containing as much as about 1000 ppm of nitrogen are produced in a relatively stable form.

The raffinate fractionator 36 also serves to separate a stream of highly crackable gas oil, designated 46, from the raffinate. The gas oil of stream 46 in addition to being very crackable (e.g., such gas oil results in relatively greater yields of naphtha and lighter gases in catalytic cracking as compared to virgin petroleum gas oils) is relatively stable despite having a relatively high nitrogen content, e.g., a nitrogen content of about 500 ppm to about 3000 ppm, whereas typically unstable gas oils have a nitrogen content above about 100 ppm, although stability is usually problematic only for lubricating oils. Thus, it is believed that while the nitrogen content of shale oil or specific fractions of shale oil cannot be directly linked to stability there appears to be a direct link between the relative amount of certain types of nitrogen compounds, e.g., especially nonbasic nitrogen compounds such as derivatives of pyrroles, indoles and carbazoles, in the shale oil or shale oil fraction and the stability of the oil or oil fraction, respectively. (Basic nitrogen compounds being defined by ASTM test D2896, all other nitrogen compounds being characterized as "nonbasic"). Thus, shale oil and specific fractions of shale oil having greater relative amounts of nonbasic nitrogen compounds tend to be less stable than otherwise similar materials having lesser relative amounts of such nonbasic nitrogen compounds.

In addition, the presence of certain aromatic hydrocarbons, such as condensed aromatic compounds (such as those common in cracked stocks) such as indene and phenalene, though not containing any nitrogen, may result in distillate instability. Thus, oil stabilization is achievable via the removal of substantially lesser amounts of nitrogen than typically required to effect stabilization of these oil materials.

As described above, the extractor 27 also products an extract phase, stream 50, which consists primarily of solvent, some aromatic hydrocarbons, and small amounts of nonaromatic hydrocarbons. The stream 50 is fed to an extract fractionator 52 wherein the extract phase is separated. In the extract fractionator 52, solvent is stripped from the extract and removed, such as shown by a flow stream 54. If desired, the solvent removed from the extract phase may, as shown in phantom by flow stream 56, be recycled in whole or in part to the extractor 27. The extract fractionator 52 also serves to fractionate the extract to recover an aromatic-containing portion, e.g., an aromatic oil shown as a stream 58 and a small, heavy, highly aromatic concentrated stream, designated 60. This small fraction of the treated oil is generally characterized as having a high nitrogen content, is typically unreactive to further hydrotreating and may act to cause distillate instability and inhibit gas oil crackability. If desired, however, the fraction may be blended into residual fuels (which may necessitate some means of controlling the emissions of nitrogen oxides ($NO_x$), such as by staged combustion) or used as a wetting agent, such as in road asphalts. In this fashion, the above-described method may serve to segregate and concentrate a large portion of the undesirable constituents remaining in the hydrotreated shale oil in a relatively small volume fraction or "bleed" stream of the shale oil. The highly aromatic material in the stream 60 can be used in asphalt or residual fuels where the material's highly aromatic nature is harmless or even beneficial (for example by wetting aggregate in paving asphalt) or, alternatively, utilized by some suitable alternate method. If desired, at least a part of the oils separated from the extract in the extract fractionator 52, which oils constitute a conditioned additional oil fraction produced by the process, e.g., these oils were additionally derived from material which had been hydrotreated, fractionated and subsequently subjected to aromatic compound removal conditioning, in accordance with one embodiment of the invention may be recycled to the hydrotreater 14 for further treatment (shown in phantom by line 62).

The method of oil stabilization of the present invention wherein hydrotreatment is followed by selective extraction, particularly aromatic extraction, allows for the use of hydrotreater reactors of a wide variety of styles and designs and has particular applicability and perceived utility for use in conjunction with back-mix hydrotreatment reactors, such as ebullated bed reactors, as such back-mix reactors are particularly well suited for handling the release of the relatively large amounts of heat that typically accompany hydrotreatment of shale oil.

Typically, shale oil hydrotreatment is done in fixed bed reactors as back-mix reactors effective for the required degree of hydrotreatment would be of such a large physical size as to render such reactors and the resulting processes uneconomical. Thus, as in accordance with the invention wherein hydrotreatment is followed by selective extraction, less severe upgrading, particularly less severe hydrotreatment (with an associated reduction in hydrogen consumption) is generally required and reduced hydrotreater reactor capacity (such as through the use of smaller or fewer such reactors) can be used, thereby facilitating the use of back-mix reactors herein. Further, the generally reduced extent of nitrogen removal associated with ebullated beds, as compared with conventional once-through fixed-bed reactors, can generally be permitted or allowed for as, in accordance with the method of the invention, the nitrogen removal capability of the hydrotreater is augmented with a downstream selective extractor. In addition, the use of a back-mix reactor, can facilitate process operation as, for example, catalyst replacement can generally be more easily accomplished with a back-mix hydrotreater reactor, while the hydrotreater remains on stream, as opposed to a fixed-bed reactor and further, back-mix reactors are typically more tolerant of various grades of shale oil feed as back-mix reactors are generally resistant to fouling by finely divided inorganic solids present in crude shale oil or by carbonaceous solids which form from the oil during hydrotreatment.

It is to be understood that, if desired, water can be added to the fractionators 36 and 52 so as to facilitate the recovery of the solvent therein as the solvents tend to partition mostly into the aqueous phase upon such water addition.

In a preferred embodiment of the invention, two hydrotreating stages are used. The first stage is an ebullated bed to which an oil feedstock, such as raw/crude shale oil, hydrogen-rich gas and, if desired, extract recycle, are fed to the bottom or lower portion. This ebullated bed hydrotreater is primarily filled with liquid and ebullated catalyst, with gas bubbles interdispersed therewith. The principal removal of nitrogen, other heteroatoms, metals, olefins and aromatic compounds occurs in this stage. As the reaction progresses, reactants and products rise to the top of the ebullated bed reactor where liquid and gas are disengaged and separated from the catalyst. A portion of the separated liquid phase stream may, if desired, be recycled to the ebullated bed to maintain ebullation of the catalyst bed. In general, the remainder of the liquid phase stream is withdrawn and preferably treated by extraction in a manner similar to stream 20 in the above-described figure.

As identified above, the gases which rise to the top of the ebullated bed reactor are disengaged and separated from the catalyst. These gases form a gaseous phase stream which, according to this preferred embodiment, are treated in a second hydrotreating stage, such as a trickle-bed reactor. In this second stage, most of the remaining nitrogen and other contaminants are removed from the lightest, more reactive portion of the partially treated feedstock oil and stable products are thereby obtained. This gas phase stream from the ebullated bed, in contrast to the liquid phase effluent from the ebullated bed, contains compounds that are generally more reactive towards further hydrotreatment. Thus this embodiment has a primary advantage of combining hydrotreating and extraction processes in a particularly efficient manner wherein materials which contain compounds that are generally reactive to further hydrotreating are upgraded by additional hydrotreating means while materials which contain compounds that are typically unreactive to further hydrotreating are further upgraded by extraction.

In addition, this embodiment may also display one or more of the following benefits:

(1) separation of reactive and unreactive compounds occurs in a manner that does not require pressure reduction between hydrotreating stages, (2) the benefits of ebullated beds, which include the capability of handling high amounts of heat release, on-line catalyst replacement, and improved resistance to fouling, for example, are obtained while efficient removal of contaminants from the gas and liquid effluents from the ebullated bed are obtained, (3) solvent recovery from the relatively heavy liquid phase effluent can be achieved by simple distillation, and (4) the severity in the hydrotreater bed can be reduced to avoid cracking of the light products.

In this preferred embodiment, the preferred operating conditions for the hydrotreating reactors and the extraction step are similar to those identified above with respect to the description of the figure. Further, the separation between the gaseous and liquid phases from the ebullated bed occurs such that the 10% boiling point of the liquid phase generally occurs in the range of about 400° F. to about 700° F.

In an alternative embodiment of the invention, the oil to be stabilized, e.g., shale oil, such as that derived from the processing of oil shale, is first fractionated such as by distillation or, alternatively, desired fractions are obtainable directly from the retort with only selected fractionates, either alone or in selected combination, being subjected to the process of hydrotreatment followed by selective extraction as taught herein. It is to be understood that in such an embodiment wherein the oil to be stabilized is preliminarily fractionated or in which only selected fractions are subjected to treatment, the need or desirability of some form of intermediary fractionation of the material being processed may be reduced or eliminated.

The following examples illustrate the practice of the invention. It is to be understood that all changes and modifications that come within the spirit of the invention are desired to be protected and thus the invention is not to be construed as limited by these examples.

EXAMPLES

In Examples I, II and III various grades of oil products, e.g., JP-4 Fuel (nominally a 250–450° F. cut), diesel fuel with 50 cetane (nominally a 450–600° F. cut) and gas oil (nominally a 650+° F. cut), respectively, were prepared by the method of the invention, and the product quality of each case evaluated.

For all the examples, shale oil was obtained by retorting oil shales having grades from 20–35 gallons of oil per ton (GPT) at a temperature of 900° F. in a one ton per day pilot plant that simulated the Lurgi process. A 200+° F. cut of the full boiling range oil was subsequently hydrotreated at 760° F., 1800 psi, and 5000 SCFB gas rate over a fixed bed containing commercial NiMo catalysts.

In Examples I and II, a feed fraction containing 650−° F. cut of the hydrotreated oil and in Example III a feed fraction of a 650+° F. cut, respectively, were extracted countercurrently in a York-Scheibel column having a diameter of one inch and eleven stages, with a solvent and at conditions specified. In each case, solvents were subsequently removed from the raffinate by water washing and the remaining oil was distilled to yield oils for fuel (Examples I and II) and catalytic cracker feed analyses (Example III, with the gas oil from Example III evaluated as a feed for catalytic cracking using a microactivity test at the conditions noted). For each example, the fraction of the oil feed contained in the raffinate is noted as the raffinate yield (vol%).

Additionally, for each of Examples I, II, and III, comparative examples (designated A and B, respectively), wherein similar or more severe degrees of hydrotreating were utilized, are presented. For each such comparative example, the degree of hydrotreating is noted by the liquid hourly space velocity (LHSV), the volume of oil passed through the bed relative to the volume of catalyst contained in the bed. In the comparative examples, however, the hydrotreating was not followed with solvent extraction as called for in the invention. The product of each was analyzed as fuel or catalytic cracking feed, accordingly.

Tables I, II, and III, respectively, show the hydrotreating conditions and product quality analysis for each of the Examples I, II, and III and corresponding comparative examples as described above with:

LHSV=liquid hourly space velocity (volume of oil passed through the catalyst bed relative to the volume of catalyst contained in the bed)

°API=API gravity

SMOKE POINT=a measure of tendency of fuel to smoke

JFTOT=a measure of thermal stability

SPOT RATING=a measure sedimentiary formation in fuel injector tube

POUR POINT=a measure of flowability of fuel in cold weather

CLOUD POINT=a measure of flowability of fuel in cold weather

AGED COLOR=a measure of stability

AGED GUM=a measure of stability

NMT=not more than

NLT=not less than

TABLE I

| | SPEC | Example I[1] | Comp. Ex. IA | Comp. Ex. IB |
|---|---|---|---|---|
| Hydrotreating: | | | | |
| LHSV | | 1.3 | 0.45 | 0.6 |
| $H_2$ Consumed (SCFB) | | 1440 | 1840 | 1720 |
| wt % Dry Gas (C1–C4) | | 1.3 | 4.8 | 3.7 |
| Vol % $C_5$+ (liquid yield) | | 105.4 | 103.2 | 104.1 |
| Raffinate Yield (vol %) | | 86 | — | — |
| Product Quality: | | | | |
| PPM N | None | 147 | 23 | 69 |
| °API | 45–57 | 49.4 | 48.9 | 48.7 |
| % Aromatics | NMT 25 | 7 | 12 | 13.5 |
| Smoke Pt. | NLT 20 | 33 | 28.5 | 27 |
| JFTOT:ΔP (mg Hg) | NMT 25 | 0.5 | 0 | 8 |
| Spot Rating (SPUN) | NMT 15 | 4.9 | 7 | 25 |
| Heat Comb. (Btu/lb.) | NLT 18,400 | 18,800 | 18,650 | 18,650 |

[1]Extraction at 70° F., with a solvent-to-feed weight ratio of 1.0 and using neat dimethyl formamide as the solvent.

TABLE II

| | SPEC | Example II[2] | Comp. Ex. IIA | Comp. Ex. IIB |
|---|---|---|---|---|
| Hydrotreating: | | 1.3 | 0.45 | 0.6 |
| LHSV | | | | |

TABLE II-continued

| | SPEC | Example II[2] | Comp. Ex. IIA | Comp. Ex. IIB |
|---|---|---|---|---|
| $H_2$ Consumed (SCFB) | | 1440 | 1840 | 1720 |
| wt % Dry Gas (C1-C4) | | 1.3 | 4.8 | 3.7 |
| Vol % $C_5$+ (liquid yield) | | 105.4 | 103.2 | 104.1 |
| Raffinate Yield (vol %) | | 93 | — | — |
| Product Quality: | | | | |
| PPM N | None | 928 | 76 | 191 |
| °API | 36-41 | 37.6 | 37.7 | 37.9 |
| Pour Pt.(°F.) | NMT 5 | −15 | −15 | −20 |
| Cloud Pt.(°F.) | NMT 15 | −8 | −15 | −20 |
| Aged Color (ASTM) | NMT 2 | 1.1 | 2.2 | 5.8 |
| Aged Gum (mg/100 cc) | NMT 3 | 1.0 | 1.0 | 1.0 |
| Cetane Index | NLT 50 | 52.5 | 52 | 52 |

[2]Extraction at 70° F., with a solvent-to-feed weight ratio of 1.2 and using dimethyl formamide with 5 vol. % water as the solvent.

TABLE III

| | Example III[3] | Comp. Ex. IIIA | Comp. Ex. IIIB |
|---|---|---|---|
| Hydrotreating: | | | |
| LHSV | 1.3 | 1.3 | 0.6 |
| $H_2$ Consumed (SCFB) | 1440 | 1440 | 1720 |
| wt % Dry Gas (C1-C4) | 1.3 | 1.3 | 3.7 |
| Vol % $C_5$+ (liquid yield) | 105.4 | 105.4 | 104.1 |
| Raffinate Yield (wt %) | 84 | — | — |
| Product Quality: | | | |
| PPM N | 1030 | 2670 | 590 |
| Basic N | 960 | 1600 | 90 |
| NMR % $C_{Aromatic}$ | 8.0 | 17 | 9.5 |
| °API | 28.9 | 27.2 | 30.1 |
| wt % Conversion[4] | 78.5 | 53.1 | 70.4 |
| Overall Conversion (wt %)[5,6,7] | 65.9 | 53.1 | 69.5 |
| wt % Coke On Catalyst[8] | 0.66 | 0.82 | 0.67 |

[3]Extraction at 120° F., with a solvent-to-feed weight ratio of 0.9 and using dimethyl formamide as the solvent.
[4]Percent converted from 430+ °F. to 430− °F. at 900° F., 25 psia, and 5:1 cat to oil.
[5]For Example III, Overall Conversion equals Raffinate Yield (wt %) multiplied by wt % Conversion.
[6]For Comparative Example IIIA as no aromatics were subsequently removed from the hydrotreated sample, overall Conversion equals wt % Conversion.
[7]For Comparative Example IIIB, overall conversion equals wt. % Conversion debited for the loss in hydrotreatment yield relative to Example III.
[8]Same conditions as Conversion.

Discussion of Examples

As shown in Tables I, II and III, the materials treated in general accordance with the method of the invention, in spite of the presence of a greater amount of nitrogen in the samples treated, had better or at least comparable product quality stability characteristics as those treated using more severe forms of hydrotreating. The adverse effects of increased hydrotreating severity are evident in the three examples as increasing the hydrotreating severity results in a reduction in the volume of liquid products ($C_5$+) despite the higher hydrogen consumption. This result can be explained as the increased hydrotreating severity may cause more hydrogen to be consumed in cracking reactions that lead to increased production of dry gas, as opposed to liquid product.

As shown in Table I, the material prepared by the method of the invention (e.g., Example I) has a lower aromatics content than corresponding oil fractions prepared using higher severity hydrotreatment. The lower aromatic content of the material prepared by the method of the invention is also reflected by this material's relatively higher °API gravity and heat of combustion. Thus, despite the higher nitrogen content of the material of Example I (147 ppm N) as compared to those of Comparative Examples IA and IB (20 and 69 ppm N, respectively), the material of Example I had comparable or better stability (as measured by JFTOT ΔP and spot rating measurements) than those of Comparative Examples IA and IB.

As shown in Table II, the material prepared by the method of the invention (e.g., Example II), despite the presence of a significantly greater relative amount of nitrogen (i.e., 928 ppm N, as compared to 76 ppm and 191 ppm N for Comparative Examples IIA and IIB, respectively) and a higher Cloud Point than that of Comparative Examples IIA and IIB, satisfied each of the identified "specs," including Aged Color. It is noted that the materials prepared in Comparative Examples IIA and IIB were both above the specification limit for Aged Color, i.e., not more than 2.

Turning to Table III, the total overall conversion for the material treated in accordance with the method of the invention (e.g., Example III) was significantly higher than that of the material in Comparative Example IIIA. Further, the coke yield on the catalyst was substantially higher in Comparative Example IIIA as compared to Example III. The higher coke yield on the catalyst in Comparative Example IIIA is believed to be largely due to the continued presence of condensed aromatics in the material prepared in accordance with the method of Comparative Example IIIA. Comparing the product quality characteristics of the material of Example III with the material of Comparative Example IIIB shows that severe hydrotreatment (Comp. Ex. IIIB) gives relatively poorer conversion than less severe hydrotreatment followed by solvent extraction of aromatic compounds (Example III), despite the higher nitrogen content and comparable aromatic content of the extracted gas oil. For Example III and Comparative Example IIIB, coke yields and overall conversions (debiting Example III for aromatics removal upon extraction and Comparative Example IIIB for lower hydrotreatment yields) are nearly the same for the two cases on a relative basis.

Conclusions

Thus, the production of materials which are relatively stable despite having relatively high nitrogen contents, by the method of the invention, can be at least in part attributed to the removal of condensed aromatics subsequent to hydrotreatment of the material.

The foregoing detailed description is given for clearness in understanding only, and no unnecessary limitations are to be understood therefrom, as modifications within the scope of the invention will be obvious to those skilled in the art.

What is claimed is:

1. A method for stabilizing an oil fraction comprising hydrocarbons having an initial boiling point of about 200° F. to about 1050° F., said method comprising the steps of:

hydrotreating an oil feedstock comprising an aromatic-containing oil fraction to be stabilized containing at least about 1 weight percent of nitrogen, said oil fraction to be stabilized comprising hydrocarbons having an initial boiling point of about 200° F. to about 1050° F. and a hydrogen-to-carbon atomic ratio of at least about 1.4 in a hydrotreater to reduce the nitrogen content of said fraction to be stabilized to a range of about 200 ppm to about 10,000 ppm and to also reduce the aromatic content of said oil fraction to result in a hydrotreated material liquid yield of greater than 100 percent; and removing condensed aromatic compounds from at least said oil fraction to be stabilized of said hydrotreated feedstock to yield a stable oil fraction.

2. The method of claim 1 wherein said step of removing condensed aromatic compounds comprises selectively extracting condensed aromatic compounds from at least said hydrotreated feedstock.

3. The method of claim 2 wherein the entire hydrotreated feedstock is selectively extracted, said method additionally comprising the step of fractionating the selectively extracted hydrotreated feedstock.

4. The method of claim 3 wherein said fractionation comprises distillation.

5. The method of claim 2 wherein said step of selective extraction comprises contacting at least said oil fraction to be stabilized of said hydrotreated feed-stock with a solvent selective for aromatic compounds.

6. The method of claim 5 wherein said solvent is selected from the group consisting of N-methyl pyrrolidone, furfural, dimethyl formamide and phensol.

7. The method of claim 5 wherein said solvent comprises an aqueous solution of no more than about 20 vol. % water of a material selected from the group consisting of N-methyl pyrrolidone, furfural, dimethyl formamide and phenol.

8. The method of claim 1 wherein said feedstock comprises a syncrude liquid.

9. The method of claim 8 wherein said syncrude liquid comprises crude shale oil.

10. The method of claim 1 wherein said stable oil fraction comprises a material selected from the group consisting of jet fuels, diesel fuels and fuel oils.

11. The method of claim 10 wherein said stable oil fraction has a nitrogen content of up to about 1000 ppm.

12. The method of claim 1 wherein said stable oil fraction comprises a gas oil fraction.

13. The method of claim 12 wherein said stable oil fraction comprises a nitrogen content of up to 3000 ppm.

14. The method of claim 1 wherein said feedstock comprises shale oil and said hydrocarbons have an initial boiling point of about 350° F. to about 650° F.

15. The method of claim 1 additionally comprising the step of fractionating said oil feedstock prior to said hydrotreatment step to yield at least said oil fraction to be stabilized, with said oil fraction to be stabilized of said feedstock subsequently subjected to said hydrotreatment step and said condensed aromatic compound removal step.

16. The method of claim 15 wherein said fractionation additionally yields at least one oil fraction selected from the group consisting of a naphtha oil fraction, a vacuum residuum oil fraction and a gas oil fraction.

17. The method of claim 1 wherein said oil feedstock comprises raw shale oil, and said method additionally comprises the step of fractionating said hydrotreated feedstock, prior to said step of removing condensed aromatic compounds, to yield at least a hydrotreated material fraction comprising a middle distillate oil fraction, with said hydrotreated material fraction subsequently subjected to said condensed aromatic compound removal.

18. The method of claim 17 wherein said step of removing condensed aromatic compounds comprises selectively solvent extracting condensed aromatic compounds from said hydrotreated material fraction and the selective solvent extraction yields an extract phase comprising solvent and an aromatic-containing portion, said method additionally comprising recycling at least a part of said aromatic-containing portion to said hydrotreater and further hydrotreating the recycled part of said aromatic-containing portion.

19. The method of claim 1 wherein, upon said hydrotreatment step, a nitrogen-rich stream is segregated from the balance of said oil feedstock being treated.

20. The method of claim 1 wherein, prior to said hydrotreatment, said oil feedstock is treated to reduce the content of material selected from the group consisting of inorganic matter, rams carbon and combinations thereof.

21. The method of claim 1 wherein said hydrotreater comprises an ebullated bed hydrotreater.

22. The method of claim 21 wherein said hydrotreatment results in the formation of a gaseous phase stream and a liquid phase stream and wherein condensed aromatic compounds are removed from said liquid phase stream by selective solvent extraction, said method additionally comprising:

further hydrotreating selected fractions of said gaseous phase stream in a hydrotreater to form a stable light hydrocarbon product.

23. A method for preparing a stabilized middle distillate oil fraction from a syncrude oil feedstock, said method comprising the steps of:

hydrotreating a syncrude oil feedstock containing at least about 1 weight percent of nitrogen and comprising an aromatic-containing middle distillate oil fraction having a hydrogen-to-carbon atomic ratio of at least about 1.4 in a hydrotreater to reduce the nitrogen content of said oil fraction being hydrotreated to a range of about 200 ppm to about 10,000 ppm and to also reduce the aromatic content of said oil fraction to result in a hydrotreated material liquid yield of greater than 100 percent; and selectively extracting said hydrotreated middle distillate fraction which contains condensed aromatic compounds by contacting said fraction with a solvent selective for removing condensed aromatic compounds to yield a stable middle distillate oil fraction.

24. The method of claim 23 wherein said syncrude comprises crude shale oil.

25. The method of claim 23 wherein said stable middle distillate oil fraction has a nitrogen content of up to about 1000 ppm.

26. The method of claim 23 wherein said solvent is selected from the group consisting of N-methyl pyrrolidone, furfural, dimethyl formamide and phenol.

27. The method of claim 23 wherein said solvent comprises an aqueous solution of no more than about 20 vol.% water of a material selected from the group consisting of N-methyl pyrrolidone, furfural, dimethyl formamide and phenol.

28. The method of claim 23 additionally comprising the step of fractionating said syncrude oil feedstock prior to said hydrotreatment step to yield at least said middle distillate oil fraction to be stabilized, with said middle distillate oil fraction to be stabilized subsequently subjected to said hydrotreatment and said selective extraction.

29. The method of claim 28 wherein said fractionation additionally yields at least one oil fraction selected from the group consisting of naphtha oil fraction, a vacuum residuum oil fraction and a gas oil fraction.

30. The method of claim 23 wherein said syncrude oil feedstock comprises raw shale oil, and said method additionally comprises a step of fractionating said hydrotreated feedstock, prior to said step of selective extraction of condensed aromatic compounds, to yield at least a hydrotreated material fraction comprising a middle distillate oil fraction, with said hydrotreated mater al fraction subsequently subjected to said condensed aromatic compound removal.

31. The method of claim 30 wherein the selective extraction yields an extract phase comprising solvent and an aromatic-containing portion, said method additionally comprising recycling at least a part of said aromatic-containing portion to said hydrotreater and further hydrotreating the recycled part of said aromatic-containing portion.

32. The method of claim 31 wherein said hydrotreater comprises an ebullated bed hydrotreater.

33. The method of claim 23 wherein, upon said hydrotreatment step, a nitrogen-rich stream is segregated from the balance of said syncrude oil feedstock being treated.

34. The method of claim 23 wherein, prior to said hydrotreatment step, said syncrude oil feedstock is treated to reduce the content of material selected from the group consisting of inorganic matter, ramscarbon and combinations thereof.

35. The method of claim 23 wherein said hydrotreater comprises an ebullated bed hydrotreater.

36. A method for preparing a stabilized middle distillate oil fraction comprising hydrocarbons having an initial boiling point of about 350° F. to 650° F. comprising the steps of:

fractionating an aromatic-containing crude shale oil feedstock containing at least about 1 weight percent of nitrogen and having a hydrogen-to-carbon atomic ratio in the range of at least about 1.4 to about 1.6 to yield at least a middle distillate oil fraction;

hydrotreating said middle distillate oil fraction in a hydrotreater to reduce the nitrogen content of at least said oil fraction to a range of about 200 ppm to about 10,000 ppm and to also reduce the aromatic content of said oil fraction to result in a hydrotreated material liquid yield of greater than 100 percent; and selectively extracting said hydrotreated middle distillate fraction which contains condensed aromatic compounds by contacting said fraction with a solvent selective for condensed aromatic compounds, said solvent selected from the group consisting of aqueous solutions of N-methyl pyrrolidone, furfural, dimethyl formamide and phenol, to yield a stable middle distillate oil fraction having a nitrogen content of up to about 1,000 ppm.

37. The method of claim 36 wherein said fractionation additionally yields at least one oil fraction selected from the group consisting of a naphtha oil fraction, a vacuum residuum oil fraction and a gas oil fraction.

38. The method of claim 36 wherein upon said hydrotreatment step, a nitrogen-rich stream is segregated from the balance of said middle distillate oil fraction being hydrotreated.

39. The method of claim 36 wherein said fractionation comprises distillation.

40. The method of claim 1 wherein said hydrogen-to-carbon atomic ratio of said oil fraction to be stabilized is in the range of at least about 1.4 to about 1.6.

41. The method of claim 23 wherein said hydrogen-to-carbon atomic ratio of said middle distillate fraction is in the range of at least about 1.4 to about 1.6.

* * * * *

UNITED STATES PATENT AND TRADEMARK OFFICE

CERTIFICATE OF CORRECTION

PATENT NO. : 5,059,303

DATED : October 22, 1991

INVENTOR(S) : James L. Tayloer, Albert L. Hensley, John M. Forgac, David F. Tatterson It is certified that error appears in the above-identified patent and that said Letters Patent is hereby corrected as shown below:

| Col. | Line | |
|---|---|---|
| 2 | 9 | "Stability of the material" should be --stability of the material-- |
| 4 | 38 | "uinaite" should be --uintaite-- |
| 4 | 47 | "uinaite" should be --uintaite-- |
| 8 | 48 | "products" should be --produces-- |
| 16 | 40 | "rams carbon" should be --ramscarbon-- |
| 17 | 35-36 | "mater al" should be --mater-ial-- |
| 15 | 35-36 | "from at least said hydrotreated feedstock" should be --from at least said oil fraction to be stabilized of said hydrotreated feedstock-- |

Signed and Sealed this

Twentieth Day of April, 1993

*Attest:*

MICHAEL K. KIRK

*Attesting Officer*

*Acting Commissioner of Patents and Trademarks*